US005203295A

United States Patent [19]

Alexander

[11] Patent Number: 5,203,295

[45] Date of Patent: Apr. 20, 1993

[54] INTERNAL COMBUSTION ENGINE

[75] Inventor: Donnie W. Alexander, Nueces County, Tex.

[73] Assignee: Spiralex Corp., Corpus Christi, Tex.

[21] Appl. No.: 937,062

[22] Filed: Aug. 27, 1992

[51] Int. Cl.[5] ..... F02B 75/22

[52] U.S. Cl. ..... 123/197.5; 123/55 R; 123/56 AC; 123/56 BC; 123/55 A

[58] Field of Search ..... 123/197.5, 55 R, 56 AC, 123/56 BC, 55 A

[56] References Cited

U.S. PATENT DOCUMENTS

| | | | |
|---|---|---|---|
| 2,779,201 | 1/1957 | Hurley | 123/197.5 |
| 2,844,040 | 7/1958 | Bancroft | 123/55 R |
| 3,991,736 | 11/1976 | Spellman | 123/197.5 |
| 4,140,440 | 2/1979 | Ferris | 123/56 BC |
| 4,641,611 | 2/1987 | Stiller et al. | 123/56 AC |
| 4,794,887 | 1/1989 | Valentine | 123/56 AC |

*Primary Examiner*—E. Rollins Cross
*Assistant Examiner*—M. Macy
*Attorney, Agent, or Firm*—G. Turner Moller

[57] ABSTRACT

A multicylinder internal combustion engine includes a plurality of reciprocating pistons each having a piston rod connected to a ball cage arrangement for converting reciprocating motion of the piston rod into rotation of a shaft coaxial with the piston rod. A one way clutch connects the coaxial shaft with an output to drive the output in one direction. A parallelogram linkage connects the piston assemblies together causing them to move in concert through the cycles of the engine.

14 Claims, 3 Drawing Sheets

INTERNAL COMBUSTION ENGINE

This invention relates to an internal combustion engine and more particularly to a multicylinder engine having an unusual drive connection between the piston rod and the output shaft.

Standard internal combustion engines have multiple pistons driving a crankshaft which is the output. The crankshaft provides a means for converting reciprocating motion of the pistons into rotation of the output shaft and also synchronizes movement of the pistons, in a four cycle engine, between intake, compression, power and exhaust strokes.

One of the inherent characteristics of a crankshaft is that the angle between the piston rod and the crank varies continuously. At the instant the fuel charge is ignited in the power stroke, the piston rod has a very poor mechanical advantage on the crank arm. This mechanical advantage improves during the downward stroke of the piston and then deteriorates again until the exhaust valves open. Thus, there is only a very short interval when the piston rod efficiently drives the crankshaft.

One oddity of conventional crankshaft internal combustion engines is that they are more fuel efficient at low rpm but do not develop much horsepower or torque until much higher rpm. Another more subtle problem is that the generation of peak pressure inside the combustion chamber, which should generate the most force on the piston and thus the greatest torque on the output, does not occur at the same point in the power stroke throughout the engine's range of speeds without sophisticated manipulation of the ignition spark. Typical state of the art response to this problem includes various sensors providing input data to computers which adjust fuel, air and ignition timing to achieve optimum coordination of cylinder pressure and mechanical advantage.

In this invention, the drive connection comprises one or more helical grooves in a first shaft and an antifriction member, such as a ball bearing, carried by the piston rod and extending into the groove. Ignition of the fuel charge drives the piston and causes the first shaft to rotate in a driven direction. A one-way clutch connects the first shaft and a second shaft connected to gearing and an output shaft. The one-way clutch allows the piston and piston rod to retract without rotating the second shaft. The pistons are interconnected by a linkage so they work in concert. In accordance with one embodiment of the invention, the linkage is a parallelogram linkage.

Disclosures of some interest relative to this invention are found in U.S. Pat. Nos. 2,294,812; 3,274,982; 3,991,736; 4,462,345 and 4,776,304.

One object of this invention is to provide an improved internal combustion engine.

Another object of this invention is to provide a multicylinder internal combustion engine having an output drive connection comprising a helical groove in a driven shaft and an antifriction follower in the groove.

These and other objects of this invention will become more fully apparent as this description proceeds, reference being made to the accompanying drawings and appended claims.

IN THE DRAWINGS

Figure 1:
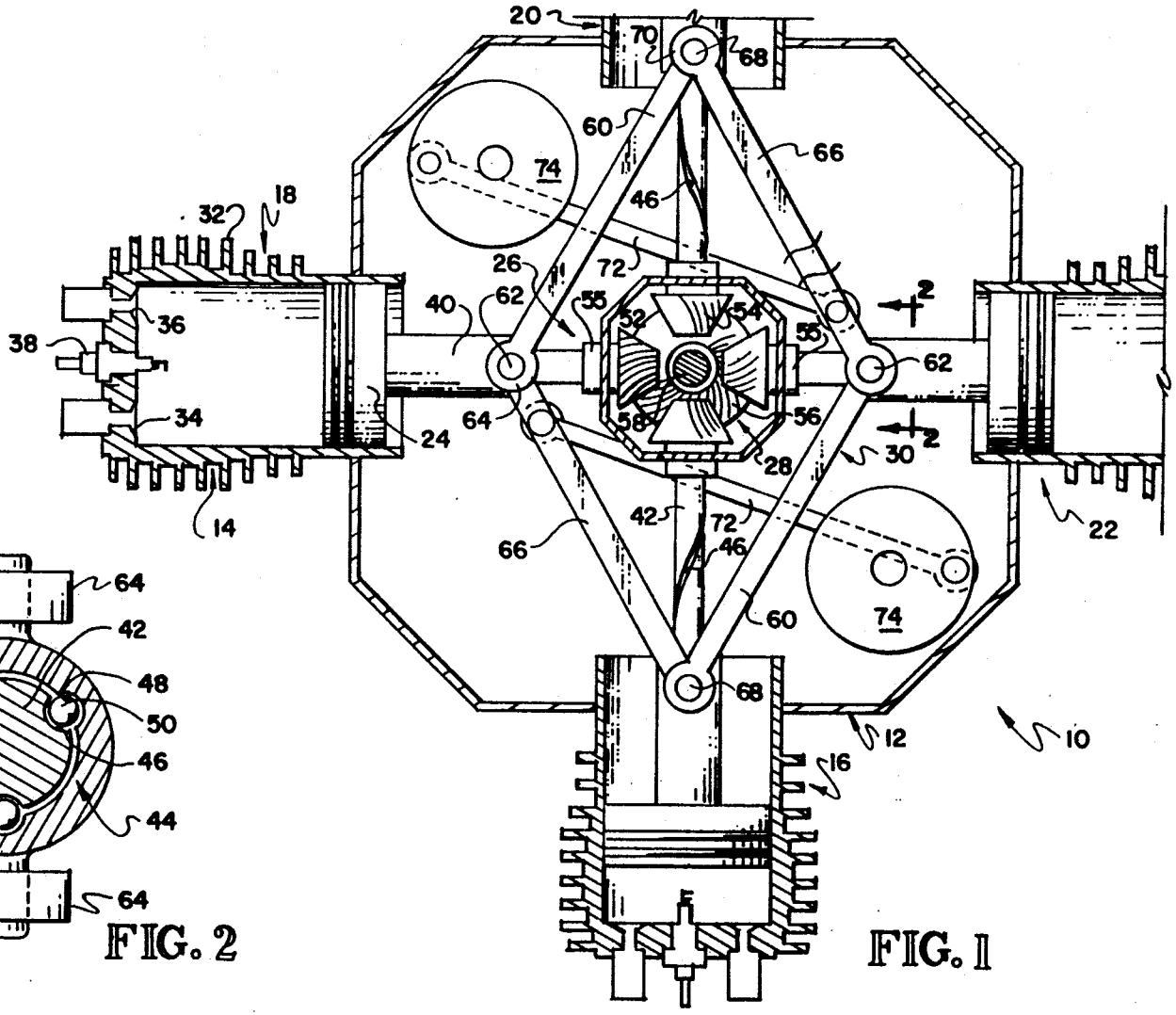
FIG. 1 is a transverse cross-sectional view of one embodiment of an internal combustion engine of this invention.
Figure 2:
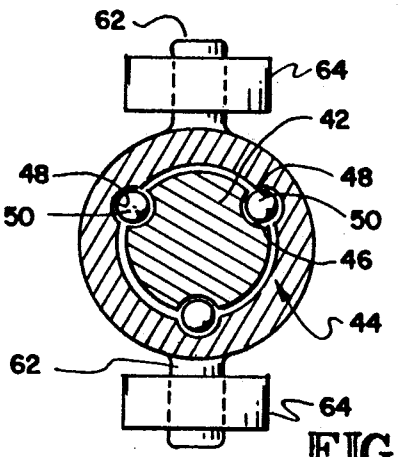
FIG. 2 is an enlarged cross-sectional view of the embodiment of FIG. 1, taken substantially along line 2—2 thereof as viewed in the direction indicated by the arrows.

Referring to FIGS. 1-2, an internal combustion engine 10 comprises, as major components, a housing 12 providing a plurality of cylinders 14 of a plurality of cylinder-piston assemblies 16, 18, 20, 22 each providing a piston 24, an output drive connection 26 for each of the assemblies driving a power output 28 and a linkage 30 interconnecting the pistons 24 for synchronized movement. Although the engine 10 is illustrated to be a four cylinder, four cycle engine, it will be evident to those skilled in the art that other particular designs are eminently suitable.

The housing 12 provides suitable engine mounts (not shown) securing the engine 10 in a suitable work position. The cylinders 14 may be welded or bolted to the housing 12 and typically provide heat exchange fins 32 so the engine 10 is air cooled although it may be water cooled if desired by the provision of a conventional water jacket. Intake structure 34, such as a valve or an injector, and one or more exhaust valves 36 is provided for each of the cylinders and suitable means (not shown) are provided for operating the intake structure 34 and opening and closing the exhaust valve 36 as is well known in the art. A suitable spark plug or igniter 38 is provided for each of the cylinders 14 and is energized at the appropriate time in the sequence of events in the engine, as is also well known in the art.

The cylinder-piston assemblies 16, 18, 20, 22 each include the cylinder 14 and the piston 24 which provides a hollow piston rod 40 having a shaft 42 telescoping received in the end thereof. A reciprocating-to-rotary motion converter 44 connects the rod 40 and shaft 42 and includes a plurality of helical grooves or slots 46 along the exterior of the shaft 42, a plurality of bearing cups or notches 48 on the inside of the rod 40 and a force transfer ball 50 cooperating between the groove 46 and the bearing cup 48.

A bevel gear 54 is drivably connected to the end of each of the shafts 42 by a one-way overrunning clutch 55 and meshes with a similar bevel gear 56 affixed to and driving an output shaft 58 connected to a transmission or other such device (not shown). Although the overrunning clutch 55 may be of any suitable type, one satisfactory model is available from INA Bearing Company, Inc. and is known as a one way needle bearing clutch. Those skilled in the art will recognize the motion converter 44 and one way clutch 55 as an arrangement which rotates the shaft 42 during inward movement of the piston 24 toward the engine axis 52 during the power stroke and allows free retraction of the piston 24 during the compression and exhaust strokes.

The linkage 30 acts to synchronize the pistons 24 so they pass sequentially through intake, compression, power and exhaust strokes as shown clockwise in FIG. 1, starting from a twelve o'clock position. The linkage 30 is of the parallelogram type. A front half of the linkage 30 includes a first pair of parallel links 60 mounted on posts 62 onto the piston rods 40 by suitable bearings 64 and a second pair of parallel links 66 mounted on posts 68 by suitable bearings 70. The linkage 30 also includes a back half identical to the front half, as suggested by the break lines in FIG. 1. The linkage 30 also comprises first and second timing links 72 connected at one end to one of the links 66 and at a second end to the periphery of a timing wheel 74. The timing wheels 74 are connected by suitable belt mechanisms or the like (not shown) to each other to insure proper directional rotation at start-up. The timing wheels 74 are constructed of suitable size and material to give the necessary fly-wheel effect so the spreading and retracting of the links 60, 66 smoothly transfers force, in a synchronized manner, from the piston in the power stroke to the pistons in the intake, compression and exhaust strokes. The timing wheels 74 also provide for starter drive connection, ignition distributor drive, external accessory drive and, perhaps most importantly, piston travel limitation.

Figure 3:
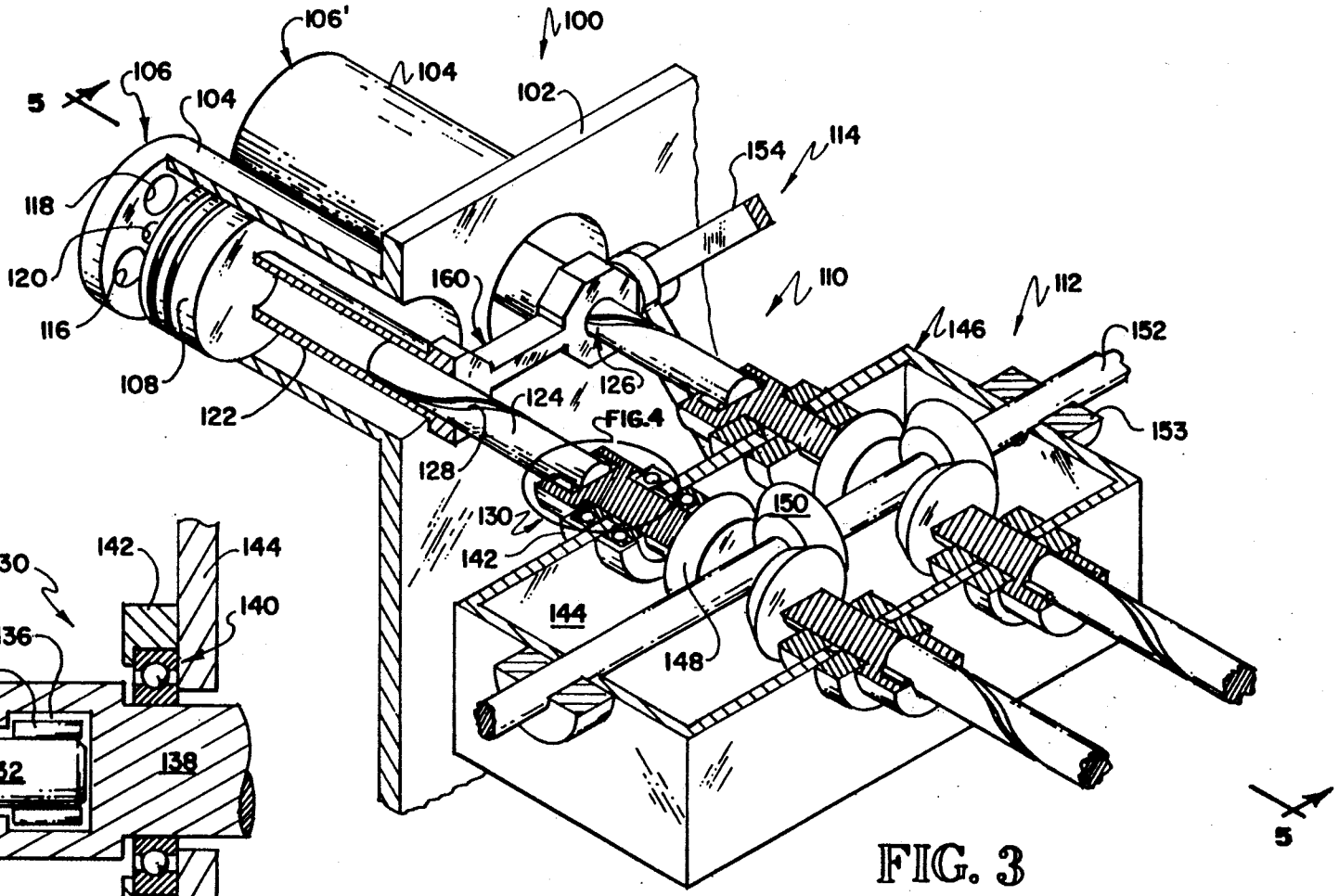
FIG. 3 is a broken isometric view of another embodiment of this invention.
Figure 4:
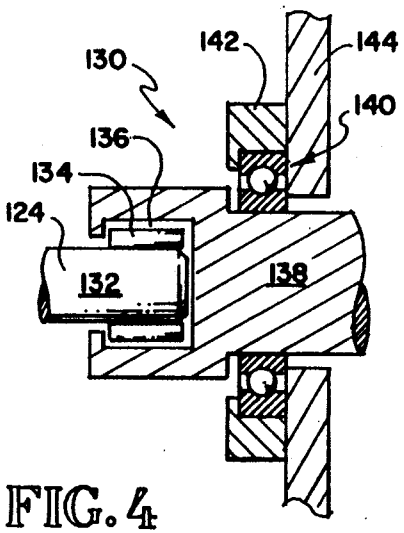
FIG. 4 is an enlarged cross-sectional view of the embodiment of FIG. 3, showing the area in the circle, as viewed from above.

Referring to FIGS. 3–4, there is illustrated another four cylinder engine 100 including, as major components, a housing 102 providing four cylinders or pots 104 of two sets of cylinder-piston assemblies 106, 106', each providing a piston 108, an output drive connection 110 for each of the assemblies driving a power output 112 and a linkage 114 interconnecting the pistons 108 for synchronized movement. As will be evident, the engine 100 is of the opposed type, i.e. two of the cylinder-piston assemblies 106, 106' are on one side of the power output 112 and two of the assemblies 106, 106' are on the other. Although the engine 100 is illustrated to be a four cylinder, four cycle engine, it will be evident to those skilled in the art that other particular designs are eminently suitable.

The housing 102 provides suitable engine mounts (not shown) securing the engine 100 in a suitable work position. The cylinders 104 may be welded or bolted to the housing 102 and accommodate suitable intake structure 116, such as a valve or an injector, and one or more exhaust valves 118. Suitable means (not shown) are provided for operating the intake structure 116 and opening and closing the exhaust valve 118 as is well known in the art. A suitable spark plug or igniter 120 is provided for each of the cylinders 104.

The cylinder-piston assemblies 106, 106' each include the cylinder 104 and the piston 108 which provides a piston rod 122 having a shaft 124 telescoping received in the end thereof. As shown in FIG. 3, the piston rod 122 is preferably hollow receiving the shaft 124 therein although the shaft 124 may be hollow receiving the piston rod 122 therein. The drive connection 110 includes a reciprocating-to-rotary motion converter 126 analogous to the converter 44 shown in FIG. 2. The converter 126 connects the piston rod 122 and the shaft 124 and includes a helical groove or slot 128 along the exterior of the shaft 124, a bearing cup (not shown) on the inside of the piston rod 122 and a force transfer ball (not shown) cooperating between the groove 128 and the bearing cup.

Those skilled in the art will recognize the motion converter 126 as a ball cage arrangement which rotates the shaft 124 in a driving direction during inward movement of the piston 108 toward the power output 112 during the power stroke and rotates the shaft 124 in an opposite direction during retraction of the piston 108 in the compression and exhaust strokes. The shaft 124 extends into a one way overrunning clutch 130 of any suitable type, such as a one way needle bearing clutch available from INA Bearing Co., Inc. This type clutch comprises an inner race 132 press fit on the end of the shaft 124, a plurality of needle bearings 134 biased by a spring (not shown) into one way rotation, and an outer race 136 press fit in a shaft 138 journalled in bearings 140 mounted by a bracket 142 on a wall 144 of a housing 146 comprising part of the power output 112. The power output 112 includes a driving bevel gear 148 connected to the end of each of the shafts 138 and meshes with a driven bevel gear 150 driving an output shaft 152 mounted in bearings 153 and connected to a transmission or other such device (not shown).

Figure 5:
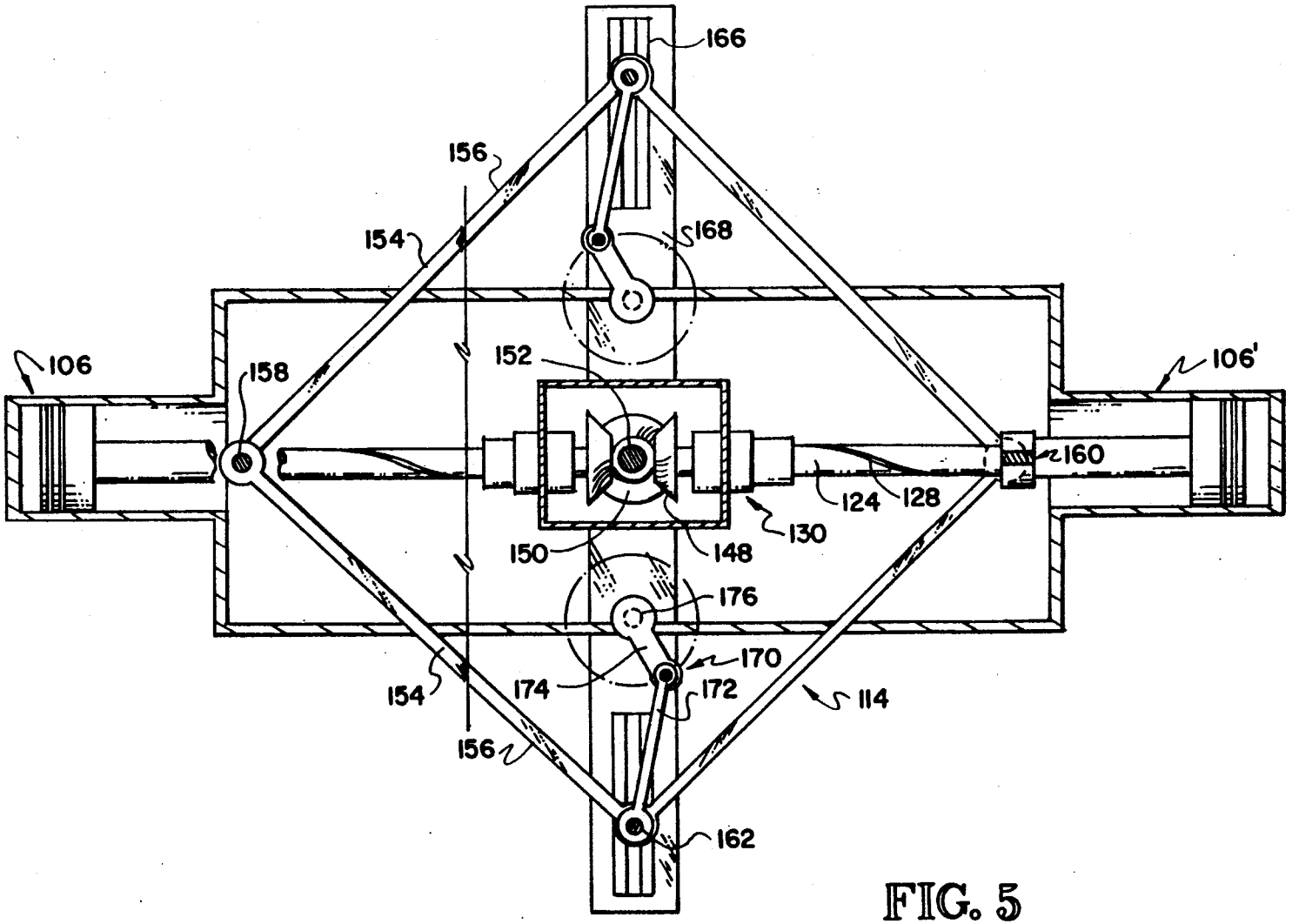
FIG. 5 is a cross-sectional view of the embodiment of FIG. 3, taken along line 5—5 thereof, as viewed in the direction indicated by the arrows, certain parts being broken away for clarity of illustration.

As shown in FIGS. 3 and 5, the linkage 114 acts to synchronize the pistons 108 so they pass sequentially through intake, compression, power and exhaust strokes and to limit the stroke of the pistons 108. The linkage 114 is a parallelogram type linkage having a first set of links 154 for the cylinders 106 and a second set of links 156 for the cylinders 106' as shown best in FIGS. 3 and 5. The links 154, 156 are essentially identical having one end mounted on a pivot post 158 provided by a cross-arm assembly 160 connecting together the outer members of the motion converters 126. The other end of the links 154, 156 are pivotally received on a slide rod 162 having an end suitably configured to be slidably received in a guide 166 carried on the end of a support 168. It will be seen that the cross arm assembly 160 accordingly assures that the adjacent piston rods 122 move together and the adjacent links 154, 156 accordingly move simultaneously.

Each of the slide rods 162 are connected to a crankshaft assembly 170 by a connecting rod 172 pivoted at one end to the middle of the slide rod 162. The other end of the connecting rod 172 is pivoted to an arm 174 mounted for rotation about a shaft 176 mounted for rotation on the support 168. The crankshaft assemblies 170 provides a plurality of functions. They limit the stroke of the pistons 108. They synchronize the linkage assembly 114 so the links 154, 156 operate simultaneously. They provide a driven shaft 176 which may be used to synchronize timing, drive valve trains and the like. Thus, the pistons in the cylinders 106, 106' on one side of the power output 112 move together through the cycles of the engine and the pistons 106, 106' on the other side of the power output 112 move together.

Operation of the engine 100 should now be apparent. Each set of the pistons 108 in the cylinders 106, 106' work simultaneously. For example, in a four cylinder four cycle engine, two of the pistons travel simultaneously through the intake, compression, power and exhaust strokes while the other two pistons travel simultaneously but are 180° out of phase. As one bank of the pistons 108 move in the power stroke, force is transmitted through the ball cage arrangements 126 to rotate the shafts 124 in a direction coupling the shaft 124 through the one-way clutches 130 to the gears 148, 150 to drive the output shaft 152. As the pistons 108 in the power stroke move inwardly, the links 154, 156 move the slide rods 162 outwardly in the guides 166 and thereby move the pistons in the other bank of cylinders through the intake stroke. The length of the stroke of the pistons 108 is controlled by the crankshaft assembly 170. Inertia in a flywheel (not shown) connected to one or both of the crankshaft assemblies 170 causes the pistons 108 to move outwardly away from the shaft 152 so one bank of the pistons 108 is in the exhaust stroke while the other bank is in the compression stroke. Those skilled in the art will see that the engine 100 continues operating in a cyclic manner.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. An internal combustion engine comprising a piston-cylinder arrangement including a cylinder having a piston reciprocating therein and a piston rod, the piston moving in a cycle including intake and power strokes;

a power output including an input shaft and an output;

a motion converter connecting the piston rod to the input shaft and comprising a helical groove on the input shaft and a ball carried by the piston rod and riding in the groove for rotating the input shaft upon movement of the piston in the power stroke, and a one-way clutch operating on the input shaft for driving the output during advance of the piston in a first direction in the power stroke and allowing free wheeling of the input shaft during retraction of the piston in a second direction;

means for limiting the stroke of the piston; and means for moving the piston at the end of the power stroke in the second direction.

2. The internal combustion engine of claim 1 wherein the piston-cylinder arrangement comprises a plurality of piston-cylinder arrangements, each including a cylinder having a piston reciprocating therein and a piston rod, each piston moving in a cycle including intake and power strokes and further comprising linkage means interconnecting the piston rods for moving the piston rods through the cycle.

3. The internal combustion engine of claim 2 wherein the linkage means provides the means for limiting the stroke of the piston and the means for moving the piston at the end of the power stroke in the second direction.

4. The internal combustion engine of claim 3 wherein the power output comprises a driven gear providing the output and a plurality of driving gears, meshing with the driven gear, providing the input shaft.

5. The internal combustion engine of claim 4 wherein the one-way clutch connects the input shaft and the driven gear for driving the driven gear during the power stroke.

6. The internal combustion engine of claim 4 wherein the driven gear includes a second input shaft having an axial opening in one end thereof, the one-way clutch being positioned in the axial opening in driving relation to the second input shaft, the first mentioned input shaft extending into the axial opening in driving relation to the one-way clutch.

7. The internal combustion engine of claim 6 wherein the one-way clutch includes an outer race in an interference fit in the axial opening, an inner race in an interference fit with the first input shaft and a plurality of one way bearing members between the inner and outer races.

8. The internal combustion engine of claim 2 wherein the linkage means comprises a parallelogram linkage including a first pair of parallel links journalled on adjacent piston rods, a second pair of parallel links defining common angles with the first pair of links, and a timing link connected at a first end to one of the parallel links and at a second end to a timing wheel.

9. The internal combustion engine of claim 8 wherein the piston-cylinder arrangements are radially related.

10. The internal combustion engine of claim 2 wherein the piston-cylinder arrangements comprise a first bank of piston-cylinder arrangements and a second opposed bank of piston-cylinder arrangements.

11. The internal combustion engine of claim 10 wherein the linkage means comprises a parallelogram linkage including a first pair of links journalled on a first end of a piston rod of the first bank, a second pair of links, defining common angles with the first pair of links, journalled on a first end of a piston rod of the second bank, a slide rod pivoted on a second end of the links of the first and second banks, a guide constraining the slide rod for linear movement, a crankshaft and a timing link pivoted at a first end to the slide rod and at a second end to the crankshaft.

12. The internal combustion engine of claim 11 further comprising means connecting the piston rods of the first bank together for simultaneous movement.

13. The internal combustion engine of claim 2 wherein the piston-cylinder arrangements comprise a first plurality of piston-cylinder arrangements and a second opposed plurality of piston-cylinder arrangements and further comprising means connecting the piston rods of the first plurality of piston-cylinder arrangements together for simultaneous movement.

14. The internal combustion engine of claim 13 further comprising means connecting the piston rods of the second plurality of piston-cylinder arrangements together for simultaneous movement in a different part of the cycle than the piston rods of the first plurality of piston-cylinder arrangements.

* * * * *